US005950266A

United States Patent [19]

Streeter et al.

[11] Patent Number: 5,950,266

[45] Date of Patent: Sep. 14, 1999

[54] METHOD AND APPARATUS FOR CONNECTING A PASSENGER BOARDING BRIDGE TO A MOVABLE BODY

[75] Inventors: Raymond K. Streeter, Arlington; Dana W. Gross, Burleson, both of Tex.

[73] Assignee: Thyssen Stearns, Inc., Kassel, Germany

[21] Appl. No.: 08/677,934

[22] Filed: Jul. 10, 1996

[51] Int. Cl.[6] ..... E01D 15/24

[52] U.S. Cl. ..... 14/69.5; 14/71.5

[58] Field of Search ..... 14/69.5, 71.1, 14/71.5, 72.5; 405/218, 219, 220, 221; 114/362

[56] References Cited

U.S. PATENT DOCUMENTS

| | | | |
|---|---|---|---|
| 427,378 | 5/1890 | Thomson | 114/362 |
| 2,581,293 | 1/1952 | Read et al. | 14/72 |
| 2,688,761 | 9/1954 | Good et al. | 14/71 |
| 2,700,169 | 1/1955 | Henion | 14/72 |
| 2,875,457 | 3/1959 | Read et al. | 14/71 |
| 3,004,391 | 10/1961 | Miller | 14/71.1 X |
| 3,038,185 | 6/1962 | Moore | 14/71 |
| 3,046,908 | 7/1962 | Der Yuen | 104/20 |
| 3,047,891 | 8/1962 | Golde et al. | 14/71 |
| 3,060,471 | 10/1962 | Der Yuen et al. | 14/71 |
| 3,086,152 | 4/1963 | Lodjic et al. | 318/32 |
| 3,099,847 | 8/1963 | Lodjic et al. | 14/71 |
| 3,110,048 | 11/1963 | Bolton | 14/71 |
| 3,121,243 | 2/1964 | Phillips | 14/71 |
| 3,123,167 | 3/1964 | Lichti | 180/6.5 |
| 3,184,772 | 5/1965 | Moore et al. | 14/71 |
| 3,263,253 | 8/1966 | Wollard et al. | 14/71 |
| 3,263,254 | 8/1966 | Wollard et al. | 14/71 |
| 3,310,823 | 3/1967 | Preiss | 14/71 |
| 3,315,291 | 4/1967 | Wollard et al | 14/71 |
| 3,317,942 | 5/1967 | Wollard et al. | 14/71 |
| 3,341,875 | 9/1967 | Wollard et al. | 14/71 |
| 3,369,264 | 2/1968 | Kurka et al. | 14/71 |
| 3,377,638 | 4/1968 | Seipos | 14/71 |
| 3,378,868 | 4/1968 | Wollard et al. | 14/71 |
| 3,391,416 | 7/1968 | Riggles, Jr. | 14/71 |

(List continued on next page.)

FOREIGN PATENT DOCUMENTS

| | | | |
|---|---|---|---|
| 3-51404 | 3/1991 | Japan | 14/71.5 |

OTHER PUBLICATIONS

Airline Industrial Machinery, Inc., Tampa, Florida—5 pages of drawings. Date of facsimile transmission Aug. 24, 1995.(drawings undated).

U.S. Patent Application NO. 08/666,841 filed Jun. 19, 1996, and entitled "Method and Apparatus for Variably Elevating a Passenger Boarding Platform".

*Primary Examiner*—James A. Lisehora

*Attorney, Agent, or Firm*—Baker & Botts, L.L.P.

[57] ABSTRACT

An apparatus for connecting a movable body (114) to a passenger boarding bridge (110)is provided. The apparatus includes a cab (118) with a periphery (206) on one end of the passenger boarding bridge. A gangway (120) connects the cab (118) to the movable body (124). The gangway (120) has a bridge end (202) for engagement with the cab (118). The apparatus further includes an automatic gangway position detection system (203) for sensing the proximity of the bridge end (122) of the gangway to the periphery (206) of the cab.

A method for connecting a passenger boarding bridge (110) to a movable body (124) having a cab (118) with a periphery (206) is provided. The method includes several steps. Those steps include providing a gangway (120), between the cab (118) and the movable body (124), the gangway (118)having a bridge end (122) and a body end (124). Further steps include engaging the bridge end (122) of the gangway with the cab (118) and engaging the body end (124) of the gangway with the moveable body (124). Additionally, the proximity of the bridge end (122) of the gangway to the periphery of the cab (206) is automatically detected with an automatic position detection system (203).

12 Claims, 2 Drawing Sheets

U.S. PATENT DOCUMENTS

| | | | |
|---|---|---|---|
| 3,402,412 | 9/1968 | Seipos | 14/71 |
| 3,404,417 | 10/1968 | Wollard et al. | 14/71 |
| 3,412,412 | 11/1968 | Kjerulf et al. | 14/71 |
| 3,422,477 | 1/1969 | Riggles, Jr. | 14/71 |
| 3,462,784 | 8/1969 | Seipos | 14/71 |
| 3,462,787 | 8/1969 | Seipos | 14/71 |
| 3,543,318 | 12/1970 | Tushim | 14/71 |
| 3,561,030 | 2/1971 | Seipos | 14/71 |
| 3,599,262 | 8/1971 | Carder et al. | 14/71 |
| 3,665,536 | 5/1972 | Jackson | 14/71 |
| 3,694,724 | 9/1972 | Eggert, Jr. | 318/648 |
| 3,875,603 | 4/1975 | Mampaey | 14/71 |
| 4,161,049 | 7/1979 | Saunders et al. | 14/71.5 |
| 4,222,140 | 9/1980 | Olewinski et al. | 14/71.3 |
| 4,333,194 | 6/1982 | Drozd | 14/71.5 |
| 4,366,591 | 1/1983 | Zimmerman | 14/71.3 |
| 4,369,538 | 1/1983 | Smedal | 14/69.5 |
| 4,473,916 | 10/1984 | Connold | 14/42 |
| 4,559,660 | 12/1985 | Lichti | 14/71.5 |
| 4,852,197 | 8/1989 | Thomas, Jr. | 14/71.5 |
| 4,984,321 | 1/1991 | Larson | 14/71.5 |
| 5,004,188 | 4/1991 | Donneky et al. | 244/137.002 |
| 5,084,936 | 2/1992 | Thomas, Jr. | 14/71.5 |
| 5,105,495 | 4/1992 | Larson et al. | 14/71.5 |
| 5,226,204 | 7/1993 | Schoenberger et al. | 14/71.5 |
| 5,257,431 | 11/1993 | Larson et al. | 14/71.5 |
| 5,267,368 | 12/1993 | Saunders | 14/71.5 |
| 5,328,252 | 7/1994 | Thompson | 301/64.4 |
| 5,359,746 | 11/1994 | Kane et al. | 14/711 |

METHOD AND APPARATUS FOR CONNECTING A PASSENGER BOARDING BRIDGE TO A MOVABLE BODY

TECHNICAL FIELD OF THE INVENTION

This invention relates generally to the field of passenger boarding bridges and more particularly to a method and apparatus for connecting a passenger boarding bridge to a movable body.

BACKGROUND OF THE INVENTION

A passenger boarding bridge is used for many purposes, such as connecting a ship or plane to a terminal. Many passenger boarding bridges in the shipping industry extend from the terminal and end with a cab near the ship, leaving a small distance between the cab and the ship. In a conventional application, this distance is spanned with a gangplank that engages with both the cab and the ship.

Although the cab may be maintained in a fixed position since the bridge is generally connected to a fixed platform, such as a dock, the ship is subject to movement with changing tides. The ship often moves in all three directions—up and down, forward and backward, and from side to side. If the movement is too extreme, the gangway could disengage from the cab or the ship, severing the connection, or alternatively, the ship could collide with the bridge. Either case could result in damage to the ship and bridge or harm to passengers.

Movement of the ship also affects the inclination of the gangway. When the ship rises or falls with the tides or moves toward or away from the cab, the inclination of the gangway will change. If ship movement is too extreme, the inclination of the gangway will become unacceptable, requiring adjustment of the cab elevation.

In the past, avoidance of collisions between the ship and the bridge, disengagement of the gangway from the ship or cab, and unacceptable slopes for the gangway, has required labor intensive monitoring of the gangway and adjustment of the cab position by the bridge operator. Therefore, a need has arisen for a new method and apparatus for connecting a passenger boarding bridge to a movable body that overcomes the disadvantages and deficiencies of the prior art.

SUMMARY OF THE INVENTION

An apparatus for connecting a passenger boarding bridge to a movable body is disclosed. The apparatus includes a cab with a periphery on one end of the passenger boarding bridge. A gangway connects the cab to the movable body. The gangway has a bridge end for engagement with the cab. The apparatus further includes an automatic gangway position detection system for sensing the proximity of the bridge end of the gangway to the periphery of the cab.

In another embodiment, an apparatus for connecting a passenger boarding bridge to a movable body is disclosed. That apparatus includes a cab with a periphery on one end of the passenger boarding bridge. A gangway connects the cab to the movable body. The gangway has a bridge end for engagement with the cab. The apparatus also includes a level sensor positioned on the gangway for detecting the inclination of the gangway and a control system for adjusting the level of the cab responsive to the level sensor.

In another embodiment, a method for connecting a passenger boarding bridge to a movable body having a cab with a periphery is disclosed. The method includes several steps. Those steps include providing a gangway, between the cab and the movable body, the gangway having a bridge end and a body end. Further steps include engaging the bridge end of the gangway with the cab and engaging the body end of the gangway with the moveable body. Additionally, the proximity of the bridge end of the gangway to the periphery of the cab is automatically detected with an automatic position detection system.

A technical advantage of the present invention is that a method and apparatus for connecting a passenger boarding bridge to a movable body is provided. Another technical advantage is that the invention provides a method and apparatus for automatically sensing possible disengagement of the connection between the bridge and the movable body. Another technical advantage of the present invention is that it provides a method and apparatus for automatically detecting the possible collision of the ship and the passenger boarding bridge. Another technical advantage is that a method and apparatus is provided for automatically maintaining an acceptable slope between the passenger boarding bridge and the moveable body. Another technical advantage of the invention is that it provides a method and apparatus for automatically alerting passengers and operators of possible disengagement of the connection between the bridge and the moveable body or the possible collision of the movable body with the passenger boarding bridge.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE INVENTION

Figure 1:
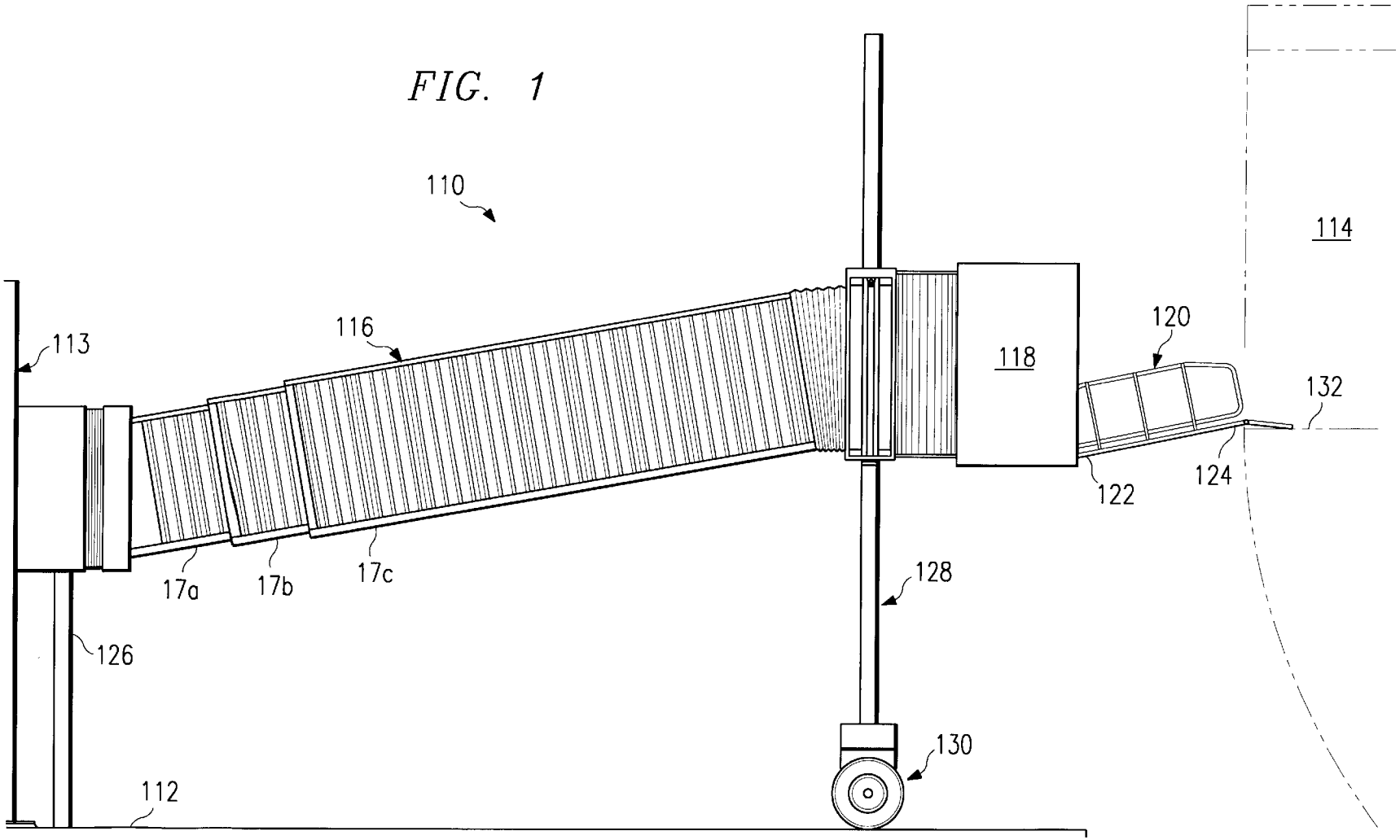
FIG. 1 illustrates a passenger boarding bridge and the gangway connecting the bridge to a ship.
Figures 2A, 2B:
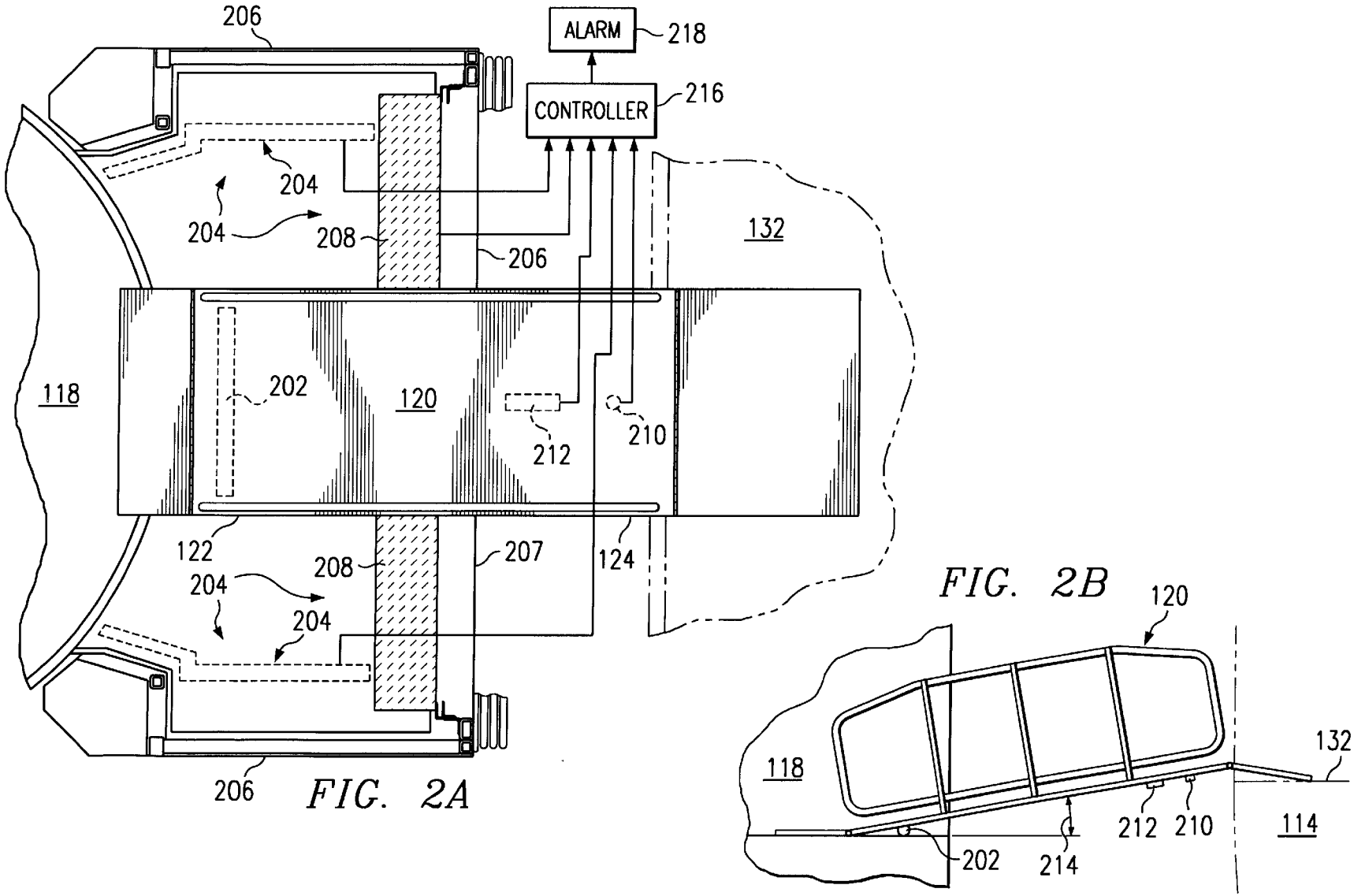
FIG. 2A illustrates an enlarged top view of the gangway connecting the bridge to the ship.
FIG. 2B shows a side view of the gangway shown in FIG. 2A.

The preferred embodiment of the present invention and its advantages are best understood by referring to FIGS. 1 through 2B of the drawings, like numerals being used for like and corresponding parts of the various drawings.

In FIG. 1, a passenger boarding bridge 110 is shown. Passenger boarding bridge 110 provides a conduit for passengers to reach a ship 114 from the dock 112. The bridge 110 often connects to a ship terminal 113 positioned on the dock 112. The bridge 110 includes a passageway 116, which may include multiple nested tunnels 17*a*, 17*b*, and 17*c*. The use of multiple tunnels 17*a*, 17*b*, and 17*c* allows for varying the length of the bridge 110 based on width of the dock 112 and distance of the ship 114 from the dock. Positioned on the end of the bridge near the ship is a cab 118.

Cab 118 may be a rotating cab, which allows the cab to be positioned in an orientation approximately perpendicular to the ship. Cab 118 is also positionable to maintain a level orientation parallel to the dock 112 while the bridge 110 may be inclined with respect to the dock 112.

Connecting the cab 118 to the ship 114 is a gangway 120. The gangway has a bridge end 122 that engages with the cab 118 and a moveable body end 124 that engages with the ship 114. As shown more completely in FIG. 2A the bridge end 122 has rollers 202 to allow a movable engagement of the bridge end 112 with the cab 118. The moveable body end 124 may be hinged to the ship 114 at the ship departure surface 132 such that gangway 120 remains in contact with the ship departure surface 132, and further connected to the moveable body end 124 in a manner that maintains the gangway 120 in an orientation perpendicular to the ship departure surface 132.

The bridge 110 is supported by a dock end support 126 and a ship end support 128. The bridge 110 may pivot about the dock end support 126. Additionally the ship end support 128 may be on a set of boggies or wheels 130. Thus, through extension of passageway 116, and pivoting about dock end support 126, the bridge may be positioned at any desired point on the dock 112. The height of ship end support 128 may be adjustable to vary the elevation of the cab 118 through extension or retraction of hydraulic cylinders in end support 128. The height of ship end support 128 may be adjusted manually or automatically through controller 216 (FIG. 2), to which the ship end support 128 is electrically connected. When the elevation of cab 118 is changed the bridge 110 is inclined; however, cab 118 may be pivoted to maintain an orientation level to the dock.

Referring now to FIG. 2A, a top view of the cab 118, gangway 120, and ship departure surface 132 is provided. Gangway roller 202 is mounted on the lower surface of gangway 120 near the bridge end 122 of the gangway 120. To detect the presence of the bridge end 122 of the gangway 120 near the periphery of the cab 118 and the possible disengagement of the bridge end 122 from the cab 118, an automatic gangway position detection system 203 is provided. The automatic gangway position detection system 203 includes at least one sensor for sensing the position of gangway 120.

In the embodiment shown in FIG. 2A, the automatic gangway position detection system includes a plurality of sensors 204 and 208 for sensing the gangway 120. Proximity sensors 204 are provided along a portion of the periphery 206 of the cab 118, as shown in FIG. 2A, for detecting the presence of the bridge end 122 of the gangway 120. In the Embodiment shown in FIG. 2A, the proximity sensors 204 are positioned near the sides of the cab 118 to detect lateral movement of the gangway 120, which may occur due to movement of the ship 114 in a direction parallel to the dock.

Proximity sensors 204 may be induction loop detectors. Such detectors are often used in roadways to detect the presence of automobiles near a traffic signal. The loop detectors used in one embodiment of the present invention are available commercially from Detector Systems and the model number is 813–103. Other types of sensors that can detect the presence of the gangway may be used to sense the gangway along the periphery of the cab near proximity sensors 204, without departing from the scope of the present invention.

The gangway position detection system 203 may also include a pressure sensitive pad 208. Pressure sensitive pad 208 is placed along the cab end 207 for detecting the presence of the bridge end 122 of the gangway 120 near the cab end 207. In the embodiment shown in FIG. 2A, the pressure sensitive pad 208 senses the bridge end 122 by pressure applied by the gangway roller 202. By placing the pressure sensitive pad 208 near the cab end 207, impending disengagement of the gangway 120 from the cab 118 can be predicted and corrective action taken. Instead of a pressure sensitive pad, a position sensor, such as those described below, may be placed on gangway 120 near roller 202 to detect the proximity of a portion of the cab end 207, and therefore the impending disengagement of the gangway 120 from the cab 118. Pressure sensitive pad 208 may also be placed along the remainder of the periphery 206 of the cab 118, as part of the automatic gangway position detection system 203, to detect the presence of the bridge end 122 of the gangway 120 near the periphery 206.

Placed on the gangway is a cab position sensor 210. Cab position sensor 210 detects the presence of the cab 118 and thus provides an indication of the distance between the ship 114 and the cab 118. As the ship 114 drifts toward the cab 118, gangway 120 rolls on rollers 202 toward the bridge 110. Since cab position sensor 210 is fixed on gangway 120, cab position sensor 210 may provide an indication of the proximity of the ship 114 to the cab 118.

Cab position sensor 210 may be any type of sensor that may detect the presence of an object, including a simple switch mounted on the gangway for engagement with the cab 118. In one embodiment of the present invention, the cab position sensor 210 may be a photoelectric sensor. Such a position sensor is available commercially from Cutler-Hammer and the model number is 13104A6517.

A level sensor 212 is mounted on the gangway 120 for detecting the inclination angle 214 (FIG. 2B)of the gangway 120. Since the ship 114 may rise or fall and drift toward or away from the cab 118, inclination angle 214 will vary. The level sensor 212 may be a pendulum-type level sensor, inclinometer, or any other type capable of producing an electronic signal responsive to changes in the inclination angle 214. One type of level sensor appropriate for use in the invention is available from PQ Controls (Model Number 410).

Level sensor 212 is connected to a controller 216 for raising or lowering the cab 118 when inclination angle 214 exceeds a predetermined limit. In one embodiment the desired inclination angle is between zero and four degrees, with two degrees serving as a desired angle. In the same embodiment, the automatic gangway position detection system 203 and the cab position sensor 210 are also connected to a controller 216, which is programmed to actuate an alarm 218 in response to detection by these sensors. The controller 216 also may be programmed to prevent the actuation of an alarm, for example during maintenance or repair of the gangway.

Although the controller 216 could automatically adjust the cab 118 in response to detection of movement of ship 114 by automatic gangway position detection system 203 and the cab position sensor 210, historical data indicates the predominate ship movement is in the vertical direction. Therefore, in one embodiment, the position of the cab 118 is adjusted manually in response to indications from the gangway position detection system 203 and the cab position sensor 210, leaving automatic adjustment of only the elevation of cab 118 to the controller 216.

The automatic position detection system 203 and cab position sensor 210 may be coupled to an alarm, either directly or through controller 216, for providing a warning to passengers and operators that the gangway 120 is nearing the periphery 206 of the cab 118 or that the ship is too close to the cab 118. In response to this warning an operator can adjust the cab position 118 through extension or retraction of passageway 116 or relocation of the ship end support 128 along the dock 112. The alarm 218 may be audible, visual, vibratory, or a variety of well known types of alarms.

Referring now to FIGS. 1–2B, the operation of the present invention will be described. In normal operation, the cab 118 is positioned close enough to the ship 114 so that the gangway may be hooked on to the ship departure surface 132 and positioned such that the bridge end 122 of the gangway may be located approximately midway between the two proximity sensors 204 located on opposite ends of the cab 114 along the periphery 206. In one embodiment, the cab 118 is then backed away approximately three feet from the ship 114, which provides a safe distance for varying movement of the ship.

As the ship 114 tilts or drifts toward the cab 118 the gangway will roll along the cab until the cab position sensor detects the cab 118. When the cab 118 is detected an alarm 218 may be triggered, alerting an operator to back the cab 118 away from the ship 114 a safe distance.

As the ship 114 drifts parallel to the dock 112 (perpendicular to the cab end 207), the gangway will also roll parallel to the dock 112. If the ships drifts enough, the bridge end 122 of the gangway will contact the periphery 206 of the cab 118 above the proximity sensor 204. Proximity sensor 204 will detect the presence of the bridge end 122 of the gangway 120. The proximity sensor 204 may trigger an alarm 218, alerting an operator to reposition the cab 118 so that the bridge end 122 of the gangway is located approximately midway between the proximity sensors 204 on opposite ends of the cab 114 along the periphery 206.

As the ship 114 tilts or drifts away from the cab 118 the gangway will roll along the cab 118 until the pressure sensitive pad detects the gangway roller 202. When the cab 118 is detected an alarm 218 may be triggered, alerting an operator to position cab 118 closer to the ship 114.

As the ship 114 rises or falls with the tide, or drifts toward or away from the cab 118, the inclination angle 214 of the gangway 120 will vary. This angle is measured by the level sensor 212. If the inclination angle exceeds a predetermined angle, a controller 216 will be activated to adjust the elevation of cab 118 through raising or lowering ship end support 128 so that it is closer to the elevation of the ship departure surface 132. In one embodiment of the present invention, the predetermined angle is zero to positive four degrees, with positive two degrees a desired set point. In the same embodiment, when the inclination angle exceeds positive four degrees, which corresponds to an upward slope of the gangway, such as that shown in FIG. 2B, the level sensor 212 sends a signal to the controller. In response to the signal, the controller adjusts the level of the cab (in this case raising it upward)until the inclination angle is approximately three degrees, at which point the signal from the level sensor is terminated. The controller 216 may also continue to reposition the cab 118 for a predetermined time period to further reduce inclination angle 214, thereby reducing cycling of the elevation of cab 118. In one embodiment, a time delay of approximately two seconds after termination of the signal from the level sensor further reduces the inclination angle from 3 degrees to 1 degrees, which overcorrects the inclination angle 214 past the desired set point of two degrees to reduce cycling. A delay may also be placed into the controller 216 so that the elevation of cab 118 is not changed in response to transient disturbances, such as waves. In one embodiment, once receiving a signal from the level sensor that the inclination angle 214 either exceeds four degrees or is less than zero degrees, the controller 216 delays adjusting the cab 118 elevation approximately ten seconds.

Although the invention has been particularly shown and described by the foregoing detailed description, it will be understood by those skilled in the art that various other changes in form and detail may be made without departing from the spirit and scope of the invention.

What is claimed is:

1. An apparatus for connecting a passenger boarding bridge to a movable body comprising:

a cab on one end of the passenger boarding bridge, the cab having a floor having a periphery;

a gangway for connecting the cab to the movable body, the gangway having a bridge end for engagement with, and movement along, the floor of the cab;

an automatic gangway position detection system comprising a pressure sensitive pad positioned on the floor of the cab such that when the bridge end of the gangway moves over a predetermined portion of the cab floor, the bridge end of the gangway moves over the pressure sensitive pad, the pressure sensitive pad having a first surface facing upward from the floor and a second surface facing downward to the floor, the pressure sensitive pad being operable to detect a force due to the weight of the bridge end of the gangway when the bridge end of the gangway is disposed on the first surface of the pressure sensitive pad.

2. The apparatus of claim 1 wherein the automatic gangway position detection system further comprises an inductive loop detector for detecting the proximity of the bridge end of the gangway to the periphery of the cab, the inductive loop detector having a conductor positioned proximate the periphery of the floor of the cab, the conductor carrying an electric current and generating an electromagnetic field proximate the periphery of the floor of the cab for interaction with the bridge end of the gangway for detecting the proximity of the bridge end of the gangway to the periphery of the floor of the cab.

3. The apparatus of claim 2, wherein the automatic position detection system further comprises a position sensor fixed on the gangway, the position sensor operable to detect that an object is within a particular distance from the sensor without contacting the object, the position sensor positioned on the gangway such that the sensor may detect that a portion of the cab is within the particular distance of the gangway, thereby providing an indication of a potential collision of the passenger boarding bridge and the moveable body.

4. The apparatus of claim 2, wherein the bridge end of the gangway further comprises a roller for rolling the bridge end along the floor of the cab, and wherein the pressure sensitive pad is further operable to detect a force due to the weight of the bridge end when the roller is disposed on the first surface of the pressure sensitive pad.

5. The apparatus of claim 1, wherein the bridge end of the gangway further comprises a roller for rolling the bridge end along the floor of the cab, and wherein the pressure sensitive pad is further operable to detect a force due to the weight of the bridge end when the roller is disposed on the first surface of the pressure sensitive pad.

6. An apparatus for maintaining a connection between a passenger boarding bridge and a ship floating on a body of water, the body of water including water that moves, the apparatus comprising:

a cab on one end of the passenger boarding bridge, the cab having a floor, the floor having a periphery;

a gangway having a bridge end in contact with the floor of the cab and an opposite end of the gangway in contact with the ship, the gangway forming the connection between the cab and the ship;

a gangway position detection system for facilitating maintaining the connection between the floor of the cab of the passenger boarding bridge and the ship, the gangway position detection system comprising:

a level sensor positioned to detect the inclination of the gangway;

a control system for adjusting the level of the cab in response to changes in the inclination of the gangway resulting from the movement of the water that the ship is floating upon in order to maintain an acceptable inclination of the gangway; and a pressure sensitive pad positioned on the cab such that when the bridge end of the gangway moves over a predetermined portion of the floor, the bridge end of the gangway moves over the pressure sensitive pad, the pressure sensitive pad having a first surface facing upward from the floor and a second surface facing downward to the floor, the pressure sensitive pad being operable to detect a force due to the weight of the bridge end of the gangway when the bridge end of the gangway is displaced on the first surface of the pressure sensitive pad.

7. The apparatus of claim 6 wherein the gangway position detection system further comprises a loop detector for detecting the proximity of the bridge end of the gangway to the periphery of the floor of the cab, the loop detector having a conductor positioned along the periphery of the floor of the cab, the conductor carrying an electrical current and generating an electromagnetic field proximate the loop for interaction with the bridge end of the gangway for sensing the proximity of the bridge end of the gangway to the periphery of the floor of the cab.

8. The apparatus of claim 7 wherein the automatic position detection system further comprises a position sensor fixed on the gangway, the position sensor operable to detect that an object is within a particular distance from the sensor without contacting the object, the position sensor positioned on the gangway such that the sensor may detect that a portion of the cab is within the particular distance of the gangway, thereby providing an indication of a potential collision of the passenger boarding bridge and the ship.

9. The apparatus of claim 6, wherein the bridge end of the gangway further comprises a roller for rolling the bridge end along the floor of the cab, and wherein the pressure sensitive pad is further operable to detect a force due to the weight of the bridge end when the roller is disposed on the first surface of the pressure sensitive pad.

10. An apparatus for maintaining a connection between a passenger boarding bridge and a ship floating on a body of water, the body of water including water that moves, the apparatus comprising:

a cab on one end of the passenger boarding bridge, the cab having a floor, the floor having a periphery;

a gangway having a bridge end in contact with the floor of the cab and an opposite end of the gangway in contact with the ship, the gangway forming the connection between the cab and the ship;

a gangway position detection system for facilitating maintaining the connection between the floor of the cab of the passenger boarding bridge and the ship, the gangway position detection system comprising:

a level sensor positioned to detect the inclination of the gangway;

a control system for adjusting the levlr of the cab in response to changes in the inclination of the gangway resulting from the movement of the water that the ship is floating upon in order to maintain an acceptable inclination of the gangway; and a loop detector for detecting the proximity of the bridge end of the gangway to the periphery of the floor of the cab, the loop detector having a conductor positioned along the periphery of the floor of the cab, the conductor carrying an electrical current and generating an electromagnetic field proximate the loop for interaction with the bridge end of the gangway, the loop detector sensing the proximity of the bridge end of the gangway to the periphery of the floor of the cab in response to the interaction.

11. The apparatus of claim 10 wherein the automatic position detection system further comprises a position sensor fixed on the gangway, the position sensor operable to detect that an object is within a particular distance from the sensor without contacting the object, the sensor positioned on the gangway such that the sensor may detect that a portion of the cab is within the particular distance from the gangway, thereby providing an indication of a potential collision of the passenger boarding bridge and the ship.

12. A method for connecting a passenger boarding bridge having a cab with a periphery to a movable body floating on water, the method comprising the steps of:

providing a gangway between the cab and the movable body, the gangway having a bridge end and a body end the cab having a floor having a periphery;

engaging the bridge end of the gangway with the cab;

engaging the body end of the gangway with the moveable body; and automatically detecting through a detection system transient movement of the movable body with respect to the cab after engaging the bridge end of the gangway and engaging the body end of the gangway in order to maintain contact between the bridge end of the gangway and the cab, the detection of the transient movement comprising detecting interaction of the bridge end of the gangway with an electromagnetic field in the proximity of the periphery of the floor.

* * * * *